United States Patent [19]

Givens et al.

[11] Patent Number: 4,675,024

[45] Date of Patent: Jun. 23, 1987

[54] PROCESS FOR PREPARING A STABILIZED COAL-WATER SLURRY

[75] Inventors: Edwin N. Givens, Bethlehem; Doohee Kang, Macungie, both of Pa.

[73] Assignee: International Coal Refining Company, Allentown, Pa.

[21] Appl. No.: 597,794

[22] Filed: Apr. 6, 1984

[51] Int. Cl.[4] ..... C10L 1/32

[52] U.S. Cl. ..... 44/51; 241/18; 241/19

[58] Field of Search ..... 44/51; 241/18, 19

[56] References Cited

U.S. PATENT DOCUMENTS

| | | | |
|---|---|---|---|
| 3,854,666 | 12/1974 | Switzer, Jr. | 241/18 |
| 4,130,401 | 12/1978 | Meyer et al. | 44/51 |
| 4,132,365 | 1/1979 | Verschuur | 241/21 |
| 4,217,109 | 8/1980 | Siwersson et al. | 44/51 |
| 4,239,496 | 12/1980 | Cochran | 241/18 |
| 4,242,098 | 12/1980 | Braun | 44/51 |
| 4,261,701 | 4/1981 | Schultz et al. | 44/51 |
| 4,394,132 | 7/1983 | Taylor | 44/51 |

FOREIGN PATENT DOCUMENTS

| | | | |
|---|---|---|---|
| 57-092089 | 6/1982 | Japan . | |
| 58-136698 | 8/1983 | Japan | 44/51 |

*Primary Examiner*—William R. Dixon, Jr.
*Assistant Examiner*—Margaret B. Medley
*Attorney, Agent, or Firm*—James W. Hellwege

[57] ABSTRACT

A process for preparing a stabilized coal particle suspension which includes the steps of providing an aqueous media substantially free of coal oxidizing constituents, reducing, in a nonoxidizing atmosphere, the particle size of the coal to be suspended to a size sufficiently small to permit suspension thereof in the aqueous media and admixing the coal of reduced particle size with the aqueous media to release into the aqueous media coal stabilizing constituents indigenous to and carried by the reduced coal particles in order to form a stabilized coal particle suspension. The coal stabilizing constituents are effective in a nonoxidizing atmosphere to maintain the coal particle suspension at essentially a neutral or alkaline pH. The coal is ground in a nonoxidizing atmosphere such as an inert gaseous atmosphere to reduce the coal to a sufficient particle size and is admixed with an aqueous media that has been purged of oxygen and acid-forming gases.

12 Claims, 2 Drawing Figures

PROCESS FOR PREPARING A STABILIZED COAL-WATER SLURRY

The Government of the United States of America has rights in this Invention pursuant to Contract No. DE-AC05-780R03054 (as modified) awarded by the U.S. Department of Energy.

BACKGROUND OF THE INVENTION

This invention relates to coal particle suspensions and more particularly to a process for preparing a stabilized coal-water slurry.

While coal is a high density energy material comparable to other premium fossil fuels, it is more difficult to handle and transport in an efficient manner as compared to liquid or gaseous fuels. To alleviate the difficulties in handling and transporting coal, coal in particle form can be suspended in water to form a mobile, pumpable slurry.

In order to economically utilize a coal-water slurry for the transporting of coal, a stable and uniform suspension of coal particles at a relatively high concentration is necessary. To this end, numerous and various methods have been proposed to prevent or reduce the settling of coal particles in the slurry and maintain the desired suspension. One general approach has been to provide an external treatment or additive to the slurry such as dispersion agents which range from natural and synthetic water soluble polymers to ionic and non-ionic surfactants.

For example, U.S. Pat. No. 4,242,098 to Braun et al. utilizes water-soluble polymers and known dispersing aids including natural and synthetic gums and the like in the aqueous coal slurry to enhance the suspension of coal in the coal-water slurry. In U.S. Pat. No. 4,217,109 to Siwersson et al., polyelectrolytes and salts of polycarboxylic acid are utilized as dispersing agents in a coal-water slurry. European Pat. No. 0041337 to Allied Colloids Limited utilizes a synthetic polymeric dispersion agent made by polymerization of ethylenically unsaturated monomers such as acrylates, methacrylates, acrylamides or methacrylamides. Still another type of coal-water suspension aid is found in U.S. Pat. No. 4,261,701 to Schultz et al. which teaches the use of reaction products obtained from the oxidation of coal with bases or basic salts.

Another general approach has been to hinder the settling velocity of the coal particles by controlling the particle size distributions and coal specific gravities. An example of such an approach is the grinding of coal to practically colloidal size so that the smallness of size inherently reduces sedimentation as disclosed in U.S. Pat. No. 4,130,401 to Meyer et al. Also, in U.S. Pat. No. 4,132,365 to Verschuur, a controlled distribution of two or more classes of particle sizes with different specific gravities is utilized to improve stability.

However, both general approaches to improving stability pose significant disadvantages. The use of special dispersion agents is often prohibitively expensive and economically unacceptable. Furthermore, these agents often complicate their application because they require additional equipment or process designs in order to meet stringent environmental requirements. Therefore, the use of extraneous additives to improve the stability of coal-water slurries has attendant disadvantages.

Controlling the particle size distribution in order to improve stability also has significant disadvantages. For example, reducing the coal to practically colloidal size as disclosed in U.S. Pat. No. 4,130,401 is cost prohibitive because of the extensive milling required to reduce the particle size to that level. In addition to the considerable energy consumption required to accomplish the necessary size reduction, disadvantages in subsequent recovery of the colloidal size particles from the slurry may be encountered.

Therefore, it is desirable to attain a stable coal-water slurry without the addition of extraneous dispersion agents and additives and without extensive grinding and milling of the coal particles.

Accordingly, it is an object of this invention to provide a process for preparing a stablized coal particle suspension by utilizing the indigenous constituents that occur naturally in the coal.

It is also an object of the invention to provide a process for preparing a stabilized coal particle suspension without extraneous additives and dispersion agents and without extensive grinding and milling.

A further object of the invention is to provide a process for preparing a coal particle suspension that exhibits improved stability for ease of handling and transporting.

A still further object of the invention is to provide an economical and cost-efficient process for preparing a stabilized coal-water slurry.

SUMMARY OF THE INVENTION

It has now been found that the foregoing and related objects and advantages may be readily attained in a process for preparing a stabilized coal particle suspension which includes the steps of providing an aqueous media substantially free of coal oxidizing constituents, reducing, in a nonoxidizing atmosphere, the particle size of the coal to be suspended to a size sufficiently small to permit suspension thereof in the aqueous media, and admixing the coal of reduced particle size with the aqueous media to release into the aqueous media coal stabilizing constituents indigenous to and carried by the reduced coal particles in order to form a stabilized coal particle suspension. The coal stabilizing constituents are effective in a nonoxidizing atmosphere to maintain the coal particle suspension at essentially a neutral or alkaline pH. The coal is ground in a nonoxidizing atmosphere such as an inert gaseous atmosphere to reduce the coal to a sufficient particle size and is admixed with an aqueous media that has been purged of oxygen and acid-forming gases. Alternately, the coal may be ground in an aqueous media purged of oxygen and acid-forming gases.

A better understanding of the invention will be obtained from the following detailed description which sets forth the several steps and the relation of one or more such steps with respect to each of the others and the relation of elements which are exemplified herein.

DESCRIPTION OF THE PREFERRED EMBODIMENT

Figure 1:
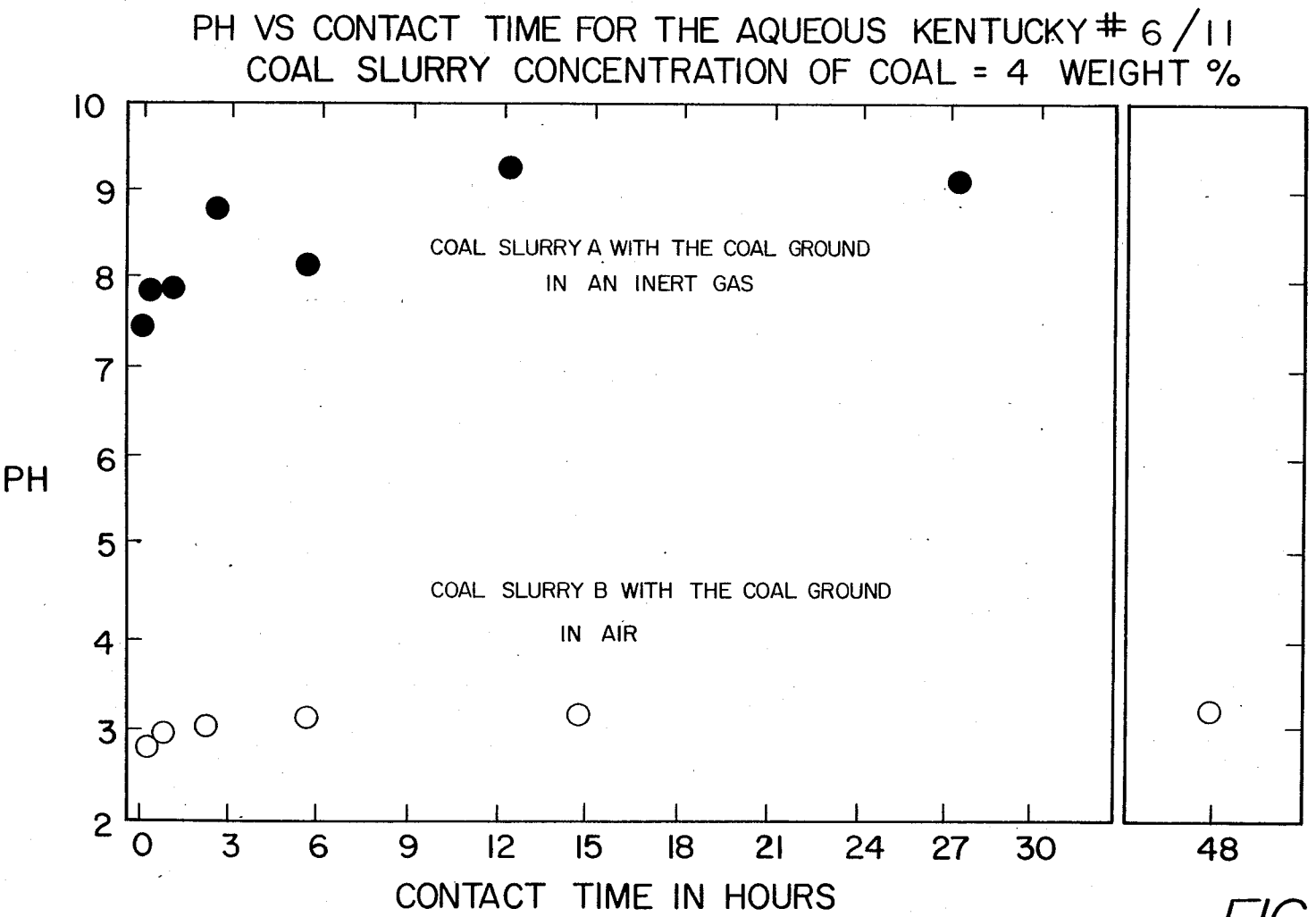
FIG. 1 is a graph illustrating the effect of the process of the present invention on the coal slurry.

In the present invention, a process for preparing a stablized coal-water suspension is provided wherein the ability to stabilize coal particle suspensions is created by the indigenous constituents that occur naturally in the coal and the stabilizing power is preserved by operating under nonoxidative slurry preparation conditions.

In preparing the stabilized coal particle suspension according to the present invention, the particle size of the coal to be suspended is reduced or ground in a non-oxidizing atmosphere to a size sufficiently small to permit suspension of the coal particles in an aqueous media. The nonoxidizing atmosphere may be an inert gas atmosphere which functions to protect the coal from oxidation.

An aqueous media is provided which is substantially free of coal oxdizing constituents including such acid forming gases as carbon disulfide, carbonyl sulfide, hydrogen sulfide, sulphur trioxide, sulfur dioxide, nitrogen oxide and nitrogen dioxide. Oxygen and the acid-forming gases are displaced from the aqueous media as by bubbling inert gas therethrough. Acid-forming gases refer to those gases which form an acidic solution when passed into contact with water. Alternately, deionized water may be utilized such as condensed steam or ground water which is passed through an ionic exchange resin. The resins include cation exchange resins such as salts of organic sulfonates or polysulfonic acids, or anion ion exchange resins such as quaternary ammonium polyamines.

The coal of reduced particle size, typically 50% smaller than 200 mesh, is admixed or slurried with the aqueous media to release into the aqueous media coal stabilizing constituents indigenous to and carried by the reduced coal particles to form the stabilized coal particle suspension. Naturally occurring coal contains various basic mineral constituents as shown in Table 1 (hereinafter) in addition to its major constituents of carbon, hydrogen, oxygen, nitrogen and sulfur. The coal as analyzed in Table 1 is Kentucky #6/11 bituminous coal. However, this invention is not limited to this particular coal and is applicable to any other coal in general.

The coal is slurried in the aqueous media in a protective atmosphere to protect the coal from oxidation. Any inert gas is effective as a protective atmosphere and any inexpensive inert gas available for a specific application is a preferable choice. The coal stabilizing constituents are partially dissolved in the aqueous media and are effective in such a nonoxidizing atmosphere to maintain the coal particle suspension at approximately a neutral or alkaline pH.

The coal-water slurry formed in accordance with this procedure exhibits an enhanced suspension stability in which complete sedimentation of particles in the slurry does not occur even under centrifugation conditions. This stability is believed to be attributable to the retained alkaline or basic nature of the water leacheate formed in this coal-water slurry.

Basic leacheate may be separated from the coal-water slurry by reducing the water content of the slurry with known procedures such as filtration or the use of a hydrocyclone separator when needed and the basic leacheate may be reused to prepare additional coal-water slurry. Adjustment of pH at any desired level can be achieved by the adjustment of adequate coal concentration, leacheate recycle and/or additional fresh water free of acid-forming gases.

Alternatively, the coal may be ground in an aqueous media which is regulated so that the pH value is at least about 7.0 and free of oxygen or acid-forming gases. While the pH level of 7.0 or higher is preferred, this invention may be performed by regulating the pH value at a level of 6.0 to 7.0, although not necessary equivalent results are achieved at the non-neutral/non-basic pH levels. For instance, in Example II, which follows, in the first run the pH of 6.84 is shown to be viable to suspend the coal particles. Thus, the reduction of particle size and the admixing with an aqueous media may be considered to occur simultaneously. The aqueous media may be exposed only to inert gases such as steam, nitrogen, argon, helium, etc., which will produce an aqueous media possessing the requisite pH of at least about 7.0. Carbon dioxide saturated water must also be purged with inert gas to eliminate the acid-forming gas concentration below a certain level. Likewise, prolonged exposure of coal in dissolved oxygen may have to be minimized so as not to create a significant oxidation problem.

The following specific examples illustrate the invention but are not to be taken as limiting its scope.

EXAMPLE I

The coal utilized in this example was Kentucky #6/11 bituminous coal and a supply of such coal was separated into two samples hereinafter referred to as "Coal A" and "Coal B". Coal A was ground in a nitrogen atmosphere to a size less than 74 microns and stored in nitrogen until used. Coal B was ground (to the same size) and stored in air with no protection from oxidation of the coal until used. The sizing of coal particles below 74 microns was based upon the preference of convenience and is not considered a limitation. Elemental compositions of Coal A and Coal B are compared in Table 1 below.

TABLE 1

Comparison of elemental compositions of Kentucky #6/11 coal ground in an inert gas and in air.

| | Coal A Kentucky #6/11 (Ground in Inert Gas) | Coal B Kentucky #6/11 (Ground in Air) |
|---|---|---|
| Wt % | | |
| Carbon | 72.96 | 71.59 |
| Hydrogen | 4.84 | 4.79 |
| Nitrogen | 1.25 | 1.38 |
| Sulfur | 3.0 | 2.9 |
| Sulfate Sulfur | 0.04 | 0.30 |
| Pyrite Sulfur | 1.59 | 0.98 |
| Oxygen By Difference | 17.95 | 19.34 |
| | 100.00 | 100.00 |
| Wt % | | |
| Aluminum | 1.04 | 1.07 |
| Iron | 1.14 | 0.88 |
| ppm | | |
| Titanium | 568 | 340 |
| Boron | 1443 | 1521 |
| Chlorine | 2500 | 2500 |
| Calcium | 56 | 57 |
| Magnesium | 419 | 473 |
| Potassium | 1582 | 1776 |
| Sodium | 279 | 359 |

About 4 wt % of each sample of Coal A and Coal B was slurried with deionized water having a neutral pH in a rotating flask blanked under argon gas atmosphere to prevent the coal slurry from air contact at the temperature of 88° C. Argon gas was utilized to achieve more efficient protection of the coal-water slurry from air for the particular apparatus applied. Periodic measurement of pH of the slurries of Coal A and Coal B is shown in FIG. 1.

The Coal A-water slurry ground and prepared in an inert gas atmosphere exhibited the basic leacheate at pH above 8.8 with only 4 wt % of coal particles in water after 3 hours, and 9.2 after 12 hours of coal-water contact time at 88° C., whereas the Coal B-water slurry in which the coal was ground in air exhibited the strongly acidic leacheate at pH slightly higher than 3 after 3 hours of coal-water contact time at 88° C. Notably, the respective coal particles of the two slurries had markedly different settling rates. The oxidized Coal B slurry completely settled in less than a few hours yielding a clean supernatent liquor. Contrarywise, the slurry prepared from Coal A ground in inert gas did not become clear during several weeks of standing or even with centrifugation at 22,000 g. of gravitational force field for 30 minutes. Apparently, complete particle settling failed to occur. However, acidification of this permanent suspension system resulted in a complete settling of the particles with the addition of hydrochloric acid. The formation of particle aggregates was visible during the movement of the acid induced sedimentation front.

EXAMPLE II

The coal utilized in this example was Kentucky #9 Mulford Coal and was separated into four samples hereinafter referred to as Coal Sample No. 1, Coal Sample No. 2, Coal Sample No. 3, and Coal Sample No. 4. The samples were prepared as follows to have different degrees of oxidation. Coal Sample No. 1 was kept under normal atmospheric weathering conditions and ground to a size smaller than 200 U.S. mesh (74 Micron) under air.

Another sample of Kentucky #9 Mulford Coal that had been kept in a tightly sealed container to protect it from extensive atmospheric air contact was ground under inert conditions to particles sizes larger than 74 Microns (Sample No. 4) and particles sizes smaller than 74 Microns (Sample No. 2).

Coal Sample No. 3 was prepared by oxidizing a portion of the Sample No. 2 under humid air at 70 degrees centigrade over 48 hours in order to simulate natural atmospheric oxidation with an identical level of mineral matter distribution which alleviates uncertainties in the experiment potentially caused by uneven distribution of mineral matter between the weathered coal and the coal ground under nitrogen gas.

In order to determine coal particle settling rates the slurries were placed into a glass gas-tight cylinder having an internal diameter of one inch and a height of 11.5 inches. Measurements of settling were conducted on slurries comprised of 40 grams of coal and 60 grams of deionized and demineralized water at room temperature by observing the downward development of a clear liquid layer that formed as particles settled. The total height of the clear liquid layer was measured in millimeters over a 24 hour period.

Figure 2:
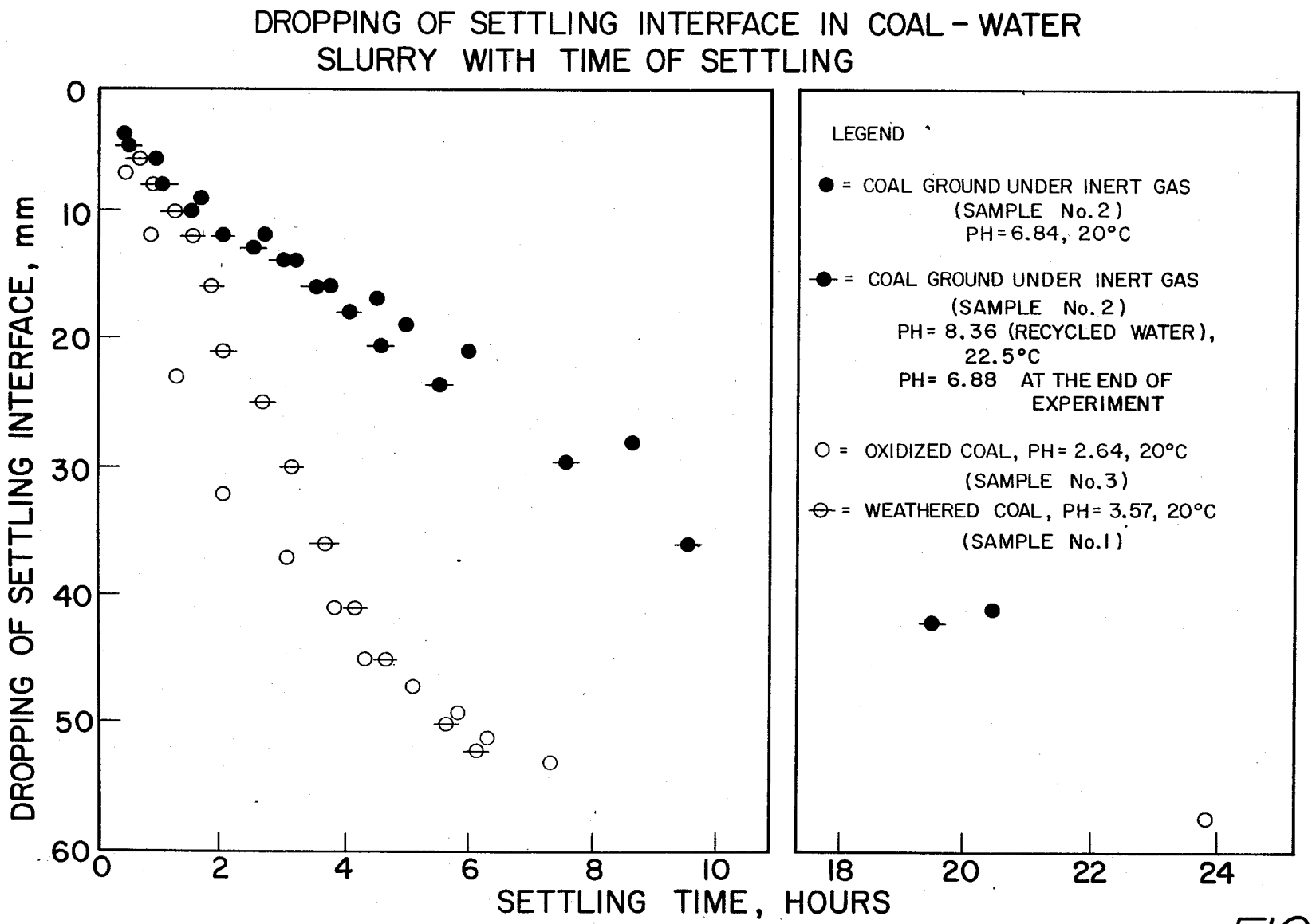
FIG. 2 is a graph illustrating the settling rates among the various coal slurry samples of Example II.

FIG. 2 compares the settling rates as determined by the dropping distances of supernatant water to coal slurry interface from the liquid surface as a function of settling time among various coal slurry samples depicted in the figure. Significant differences in the settling rates between the non-oxidized coals and oxidized coals are apparent showing considerable improvement of stabilization with the less oxidized coals.

Experiments with oxidized coal Samples No. 1 and No. 3 showed that the supernatant water taken from the slurries had pH values of 3.57 and 2.64, respectively, and that both settled quite rapidly (FIG. 2). The supernatant water taken from a slurry of non-oxidized coal Sample No. 2 had a pH of 6.84 and settled at a significantly lower rate than oxidized coal of Samples No. 1 and No. 3.

In another experiment deionized and demineralized water was intimately mixed with coal Sample No. 4 under argon at 80° C. for a period of 3 hours. The water referred to as "recycled water" that was separated from the coal particles had a pH of 8.36. This water was then used to make a 40% slurry using coal Sample No. 2. The settling rate of this "recycled water" coal slurry was comparable to the non-oxidized slurry of coal Sample No. 2 discussed above (FIG. 2). The pH of the supernatant water removed from this coal slurry at the end of the settling experiment after 19 hours had a pH of 6.88.

Thus, it can be seen that the process of the present invention provides a stabilized coal particle suspension created by the indigenous constituents that occur naturally in coal wherein the stabilizing power is preserved by operating under non-oxidative slurry preparation conditions. Ease of handling is thereby attained in a stabilized slurry without the addition of extraneous agents or extensive grinding.

The present invention has general applicability to coal-water slurries that can be utilized in any process that requires the transportation of a coal-water slurry such as to pipeline coal over long distances, to inject coal into a gasifier or other high pressure systems, or to retrofit oil-fired boilers. As will be apparent to persons skilled in the art, various modifications and adaptations of the method above-described will become readily apparent without departure from the spirit and scope of the invention.

I claim:

1. A process for preparing a stabilized coal particle suspension of ground coal in an aqueous media comprising the steps of:

providing an aqueous media substantially free of oxygen and acid-forming gases;

reducing, in a nonoxidizing atmosphere, the particle size of the coal to be suspended in said aqueous media to a size sufficiently small to permit suspension thereof in the said aqueous media; and thereafter admixing the coal of reduced particle size with the said aqueous media to release into the aqueous media coal stabilizing constituents indigenous to and carried by said coal particles of reduced particle size to form a stabilized coal particle suspension.

2. The process of claim 1 wherein the step of reducing the particle size of the coal and the step of admixing take place substantially simultaneously.

3. The process of claim 1 wherein the step of reducing the particle size of the coal to be suspended comprises grinding the coal in a nonoxidizing atmosphere.

4. The process of claim 3 wherein the coal is ground in an inert gaseous atmosphere.

5. The process of claim 3 wherein the coal is ground in a nitrogen atmosphere.

6. The process of claim 1 wherein the coal to be suspended is ground in an aqueous media purged of oxygen and acid-forming gases.

7. The process of claim 1 wherein the coal to be suspended is ground in an acid-free media.

8. The process of claim 1 further comprising the step of storing the coal of reduced particle size in a nonoxidizing atmosphere effective to prevent oxidation of the coal of reduced particle size prior to admixing with the aqueous media.

9. The process of claim 8 wherein the coal of reduced particle size is stored in a nitrogen atmosphere prior to admixing with the aqueous media.

10. The process of claim 1 wherein the coal of reduced particle size is admixed with the aqueous media to form a stabilized coal particle suspension having a concentration of coal at least four percent by weight.

11. The process of claim 1 further comprising the step of removing basic leacheate from the stabilized coal particle suspension for reuse in the preparation of additional coal particle suspension.

12. The process of claim 1 wherein said aqueous media is rendered substantially free of oxygen and acid-forming gases by passing an inert gas through the aqueous media prior to admixing with the coal to remove oxygen and acid-forming gases present therein.

* * * * *